US009865103B2

(12) United States Patent
Kraeling et al.

(10) Patent No.: US 9,865,103 B2
(45) Date of Patent: Jan. 9, 2018

(54) IMAGING SYSTEM AND METHOD

(71) Applicant: General Electric Company, Schenectady, NY (US)

(72) Inventors: Mark Bradshaw Kraeling, Melbourne, FL (US); Brian Joseph McManus, Fort Worth, TX (US); Michael Miner, Melbourne, FL (US)

(73) Assignee: General Electric Company, Schenectady, NY (US)

( * ) Notice: Subject to any disclaimer, the term of this patent is extended or adjusted under 35 U.S.C. 154(b) by 269 days.

(21) Appl. No.: 14/455,571

(22) Filed: Aug. 8, 2014

(65) Prior Publication Data

US 2015/0235484 A1 Aug. 20, 2015

Related U.S. Application Data

(60) Provisional application No. 61/940,584, filed on Feb. 17, 2014.

(51) Int. Cl.
*G07C 5/08* (2006.01)

(52) U.S. Cl.
CPC ..... *G07C 5/0866* (2013.01)

(58) Field of Classification Search
CPC ..... H04N 5/144; G08B 13/19602; G08B 13/19695; G08B 13/19647
See application file for complete search history.

(56) References Cited

U.S. PATENT DOCUMENTS

| | | | |
|---|---|---|---|
| 6,011,901 | A | 1/2000 | Kirsten |
| 6,128,558 | A | 10/2000 | Kernwein |
| 6,532,038 | B1 | 3/2003 | Haring et al. |
| 7,813,846 | B2 | 10/2010 | Wills et al. |
| 7,965,312 | B2 | 6/2011 | Chung et al. |
| 8,180,590 | B2 | 5/2012 | Szwilski et al. |
| 8,292,172 | B2 | 10/2012 | Logan et al. |
| 8,406,943 | B2 | 3/2013 | Brand et al. |
| 8,599,005 | B2 | 12/2013 | Fargas et al. |
| 8,712,610 | B2 | 4/2014 | Kumar |
| 8,744,196 | B2 | 6/2014 | Sharma et al. |
| 2003/0222981 | A1 | 12/2003 | Kisak et al. |

(Continued)

FOREIGN PATENT DOCUMENTS

| | | | |
|---|---|---|---|
| EP | 953491 | B2 | 11/1999 |
| EP | 1600351 | A1 | 11/2005 |
| WO | 2006112959 | A2 | 10/2006 |

OTHER PUBLICATIONS

Swann, 960H Digital Video Recorder, (2013).*

(Continued)

*Primary Examiner* — Redhwan K Mawari
*Assistant Examiner* — Michael Whalen
(74) *Attorney, Agent, or Firm* — Global Patent Operation; John A. Kramer

(57) ABSTRACT

An imaging system includes a camera and a controller. The camera is configured to be disposed on a first vehicle system or at a wayside location along a route to generate image data within a field of view of the camera. The controller is configured to monitor a data rate at which the image data is provided from the camera. The controller also is configured to identify a stimulus event within the field of view of the camera based on a change in the data rate at which the image data is generated by the camera.

23 Claims, 4 Drawing Sheets

(56) References Cited

U.S. PATENT DOCUMENTS

| | | | | |
|---|---|---|---|---|
| 2005/0147383 | A1* | 7/2005 | Ihara | G11B 27/005 386/241 |
| 2008/0151050 | A1* | 6/2008 | Self | G08B 13/19658 348/143 |
| 2009/0167862 | A1* | 7/2009 | Jentoft | G08B 13/19641 348/143 |
| 2009/0276108 | A1 | 11/2009 | Kumar et al. | |
| 2010/0039514 | A1 | 2/2010 | Brand | |
| 2010/0061460 | A1* | 3/2010 | Weber | H04N 19/117 375/240.16 |
| 2010/0070172 | A1 | 3/2010 | Kumar | |
| 2010/0091864 | A1* | 4/2010 | Tada | H04N 19/159 375/240.16 |
| 2010/0183074 | A1* | 7/2010 | Furukawa | G06T 3/4007 375/240.16 |
| 2010/0265344 | A1* | 10/2010 | Velarde | H04N 5/232 348/208.16 |
| 2011/0216200 | A1 | 9/2011 | Chung et al. | |
| 2013/0168503 | A1 | 7/2013 | Cooper et al. | |
| 2014/0043480 | A1* | 2/2014 | Wu | H04N 21/2181 348/143 |

OTHER PUBLICATIONS

International Search Report and Written Opinion issued in connection with corresponding PCT Application No. PCT/US2015/013183 dated Apr. 30, 2015.

* cited by examiner

IMAGING SYSTEM AND METHOD

CROSS-REFERENCE TO RELATED APPLICATIONS

This application claims priority to U.S. Provisional Application Ser. No. 61/940,584, which was filed on 17 Feb. 2014, and is entitled "Imaging System And Method," the entire disclosure of which is incorporated by reference.

FIELD

Embodiments of the subject matter described herein relate to imaging systems, such as imaging systems onboard or near vehicle systems.

BACKGROUND

Vehicle systems such as trains or other rail vehicles can include cameras disposed on or near the vehicle systems. These cameras can be used to record actions occurring outside of the vehicle systems. For example, forward facing cameras can continuously record video of the locations ahead of a train. If a collision between the train and another vehicle occurs (e.g., an automobile is struck at a crossing), then this video can later be reviewed to determine liability for the collision, whether the other vehicle improperly moved through a gate or signal, whether the train was moving too fast, or the like.

One problem with these cameras is that the cameras are analog cameras that continuously record videos. Due to limited memory space, not all of the video is saved. For example, older video is erased and written over in a recording loop. As a result, some of the video that can be relevant to a post-accident investigation may be lost.

Additionally, if the operator witnesses something along the route that is captured by the video obtained by the camera, the video can later be reviewed to examine the item of interest along the route. But, if the recorded video is long, then it may be difficult and/or time consuming to identify the time at which the object is shown in the video.

Some vehicle systems are prone to trespassers. For example, due to the size of trains, the trains can be susceptible to trespassers entering into one or more locomotives or rail cars of the trains without being detected. The train can be inspected by operators of the train, but this inspection can take a considerable amount of time.

Some vehicle systems also may include multiple vehicles coupled with each other. For example, some trains can include multiple locomotives joined by rail cars. Operators may be disposed onboard the locomotives, but one operator may not be able to see the other operator without leaving the locomotive and moving to the other locomotive. During movement, the operators are unable to see each other and may not be able to ensure that the other is alert and operating the locomotive properly.

BRIEF DESCRIPTION

In one example of the inventive subject matter described herein, a system (e.g., an imaging system) includes a camera and a controller. The camera is configured to be disposed on a first vehicle system or at a wayside location along a route to generate image data within a field of view of the camera. The controller is configured to monitor a data rate at which the image data is provided from the camera. The controller also is configured to identify a stimulus event within the field of view of the camera based on a change in the data rate at which the image data is generated by the camera.

In another example of the inventive subject matter described herein, a method (e.g., an imaging method) includes obtaining image data of a field of view of a camera. The field of view includes at least a portion of a first vehicle system. The method also includes monitoring, with one or more computer processors, a data rate at which the image data is provided from the camera, and identifying (with the one or more computer processors) a stimulus event within the field of view of the camera based on a change in the data rate at which the image data is generated by the camera.

In another example of the inventive subject matter described herein, a system (e.g., an imaging system) includes a camera and a controller. The camera is configured to be disposed onboard a first vehicle of a vehicle system that includes the first vehicle and at least a second vehicle mechanically coupled with each other. The camera also is configured to obtain image data, compress the image data into compressed image data, and output the compressed image data at a bit rate. The controller is configured to monitor the bit rate at which the compressed image data is output and to identify a stimulus event occurring on or at the first vehicle responsive to the bit rate changing by at least a designated threshold. The controller also is configured to generate one or more alarm signals responsive to the bit rate changing by at least the designated threshold.

BRIEF DESCRIPTION OF THE DRAWINGS

The subject matter described herein will be better understood from reading the following description of non-limiting embodiments, with reference to the attached drawings, wherein below.

DETAILED DESCRIPTION

One or more embodiments of the inventive subject matter described herein relate to imaging systems and methods for vehicle systems. While several examples of the inventive subject matter are described in terms of rail vehicles (e.g., trains, locomotive, locomotive consists, and the like), not all embodiments of the inventive subject matter is limited to rail vehicles. At least some of the inventive subject matter may be used in connection with other off-highway vehicles (e.g., vehicles that are not permitted or designed for travel on public roadways, such as mining equipment), automobiles, marine vessels, airplanes, or the like.

Figure 1:
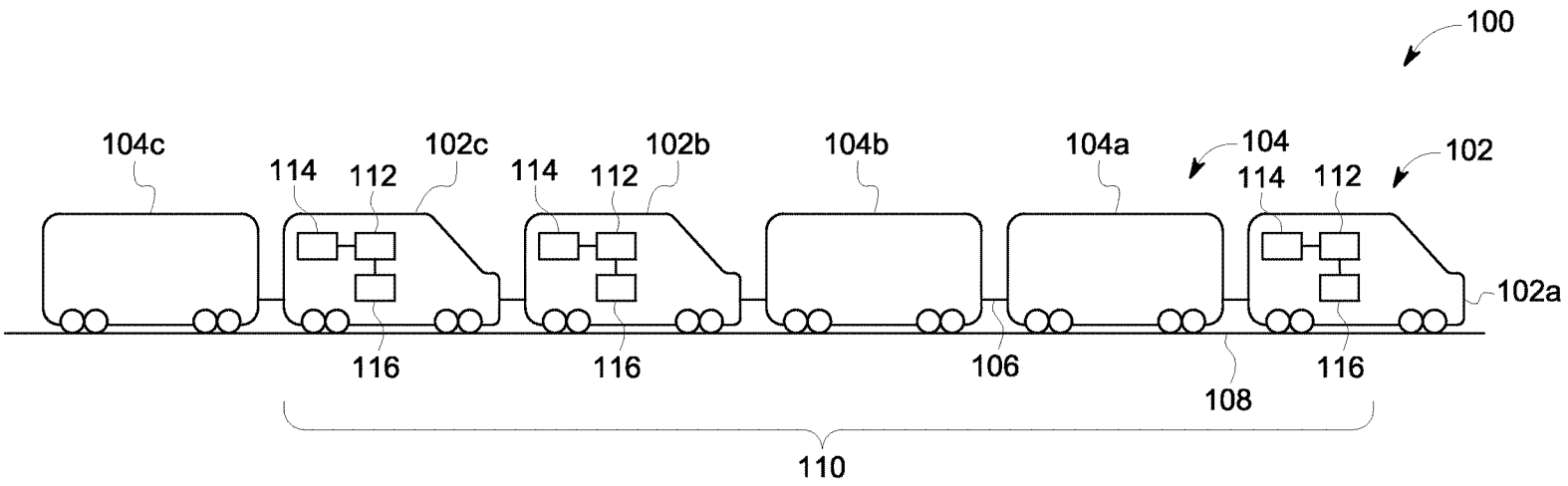
FIG. 1 is a schematic illustration of a vehicle system according to one example of the inventive subject matter.

FIG. 1 is a schematic illustration of a vehicle system 100 according to one example of the inventive subject matter. The vehicle system 100 includes several propulsion-generating vehicles 102 (e.g., vehicles 102*a-c*) mechanically coupled with each other and/or several non-propulsion-generating vehicles 104 (e.g., vehicles 104*a-c*) by couplers 106. The vehicles 102, 104 are coupled with each other to travel along a route 108 together. In the illustrated example, the vehicle system 100 is a rail vehicle system with locomotives (e.g., vehicles 102) and rail cars (e.g., vehicles 104), but alternatively may be another vehicle system. The number and arrangement of the vehicles 102, 104 are provided merely as one example. The vehicle system 100 may include a different number and/or arrangement of the vehicles 102, 104. As one example, the vehicle system 100 may be formed from a single vehicle 102 or 104.

The vehicle system 100 includes an imaging system 110 disposed onboard one or more of the vehicles 102, 104. The imaging system 110 includes one or more cameras 112, one or more camera controllers 114, and/or one or more stimulus sensors 116. While the illustrated example shows each of the vehicles 102 including a camera 112, a controller 114, and a sensor 116, optionally, one or more of the vehicles 104 may include a camera, controller, and/or sensor, and/or one or more of the vehicles 102 may not include a camera, controller, and/or sensor.

The cameras 112 may include internal and/or external cameras. An internal camera is a camera that is coupled with the vehicle system 100 so that a field of view of the camera (e.g., the space that is imaged or otherwise represented by image data generated by the camera) includes at least part of an interior of the vehicle system 100. An external camera is a camera that is coupled with the vehicle system 100 so that the field of view of the camera includes at least part of the exterior of the vehicle system 100. At least one of the cameras 112 may be a cab camera, or a camera that is mounted inside the vehicle 102 to obtain image data of a location where an operator of the vehicle 102 sits or otherwise works to control operations of the vehicle 102 while the vehicle system 100 moves along the route 108. The image data obtained by the cameras 112 can be electronic data representative of still images and/or moving videos.

One or more of the cameras 112 may be digital cameras capable of obtaining relatively high quality image data (e.g., static or still images and/or videos). For example, the cameras may be Internet protocol (IP) cameras that generate packetized image data. The cameras 112 can be high definition (HD) cameras capable of obtaining image data at relatively high resolutions. For example, the cameras 112 may obtain image data having at least 480 horizontal scan lines, at least 576 horizontal scan lines, at least 720 horizontal scan lines, at least 1080 horizontal scan lines, or an even greater resolution.

The controllers 116 include or represent hardware circuits or circuitry that includes and/or is connected with one or more computer processors, such as one or more computer microprocessors. As described herein, the controllers 116 dictate operational states of the cameras 112, monitor the cameras 112 to sense movement in and/or around the vehicle system 100, save image data obtained by the cameras 112 to one or more memory devices, generate alarm signals responsive to identifying various stimuli from the image data, and the like.

Figure 2:
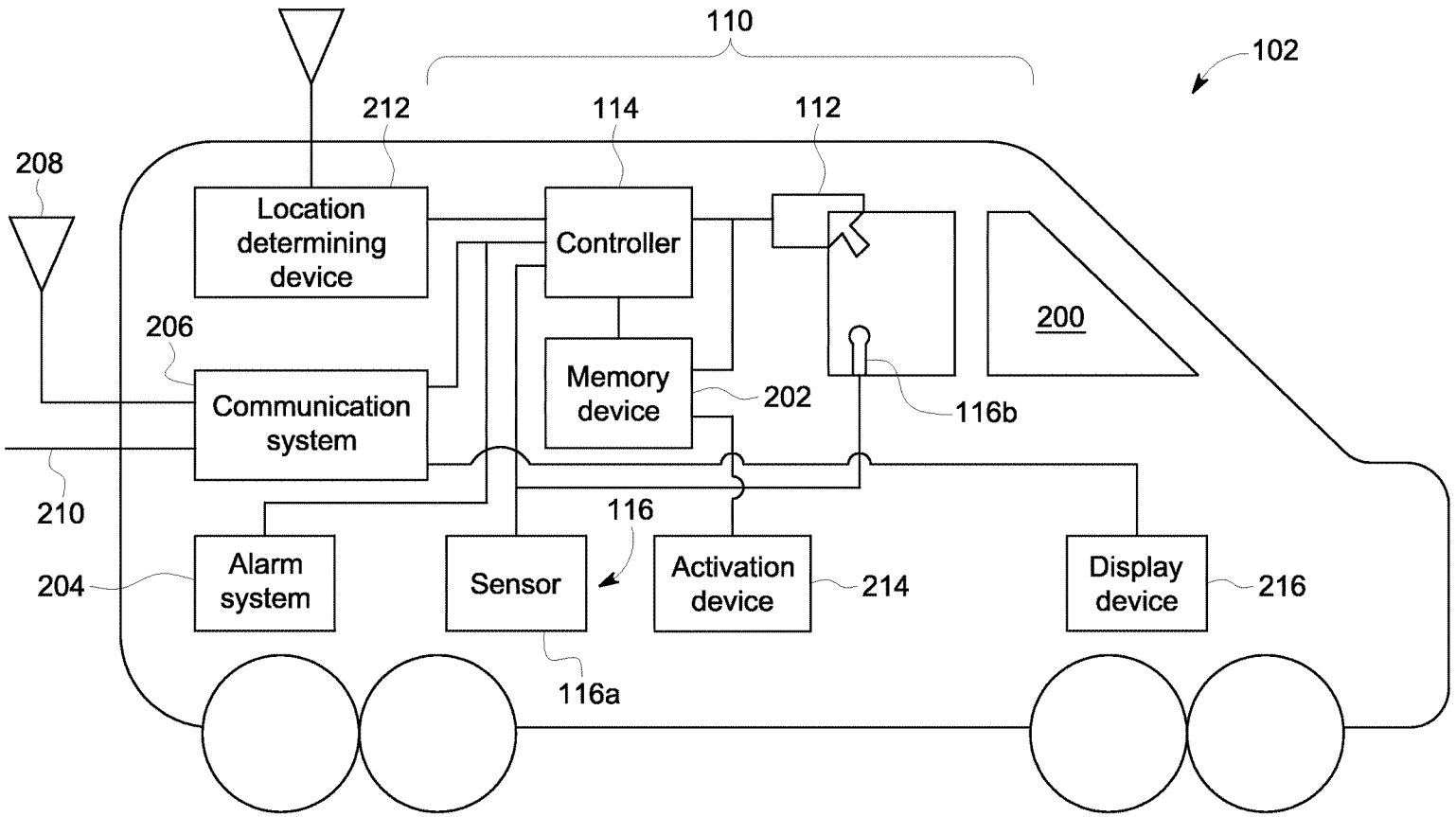
FIG. 2 is a schematic illustration of an imaging system shown in FIG. 1 disposed onboard at least one vehicle shown in FIG. 1 according to one example of the inventive subject matter described herein.

FIG. 2 is a schematic illustration of the imaging system 110 disposed onboard at least one of the vehicles 102 shown in FIG. 1 according to one example of the inventive subject matter described herein. The vehicle 102 shown in FIG. 2 includes an interior camera 112 (which also can be referred to as a cab camera when the field of view of the camera 112 includes an interior space or chamber 200 of the vehicle 102 where an operator is located to control movement or other operations of the vehicle 102).

The cameras 112 can be used in connection with onboard sensors 116 on the vehicle 102 to control an active or inactive state of the cameras 112, control which portion of the image data obtained by the cameras 112 is saved, or the like. The cameras 112 and/or sensors 116 may be used to provide a variety of increased functionality for the vehicle system 100 (shown in FIG. 1). As one example, when the vehicle system 100 is sitting still for at least a designated period of time, the controller 114 can deactivate the camera 112. The controller 114 can represent hardware circuits or circuitry that include and/or are connected with one or more computer processors, such as computer microprocessors. While the controller 114 is shown as being disposed onboard the same vehicle 102 as the camera 112 being controlled by the controller 114, optionally, the camera 112 may be controlled by a controller disposed on another vehicle 102, 104 (shown in FIG. 1) of the same vehicle system 100, by a controller disposed onboard another vehicle system, or a controller located off-board any vehicle system (e.g., at a dispatch facility or other facility).

In one embodiment, the camera 112 may continue to obtain image data when the camera 112 is in a deactivated state, but only during a moving time window. For example, the camera 112 may continuously or otherwise obtain the image data, but the image data acquired longer than a designated time period (e.g., 30 seconds, five minutes, ten minutes, or another time period) is discarded and not saved for later review.

Figure 3:
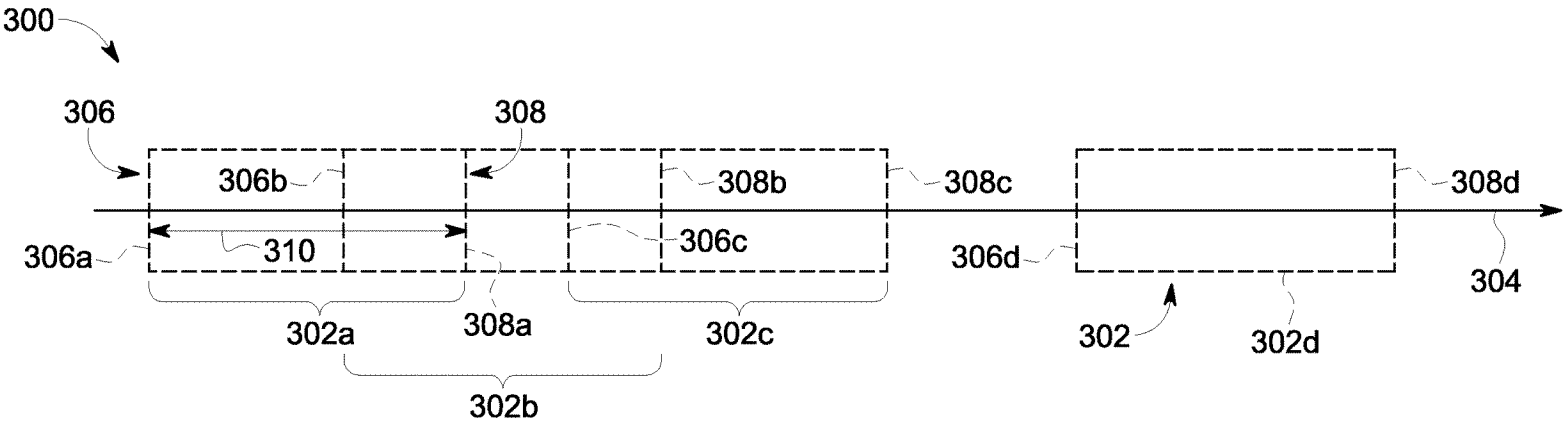
FIG. 3 illustrates a timeline projection of a moving time window over which image data obtained by the camera shown in FIG. 1 is kept when the camera is in a deactivated or inactive state according to one example of the inventive subject matter described herein.

FIG. 3 illustrates a timeline projection 300 of a moving time window 302 (e.g., windows 302*a-f* shown in FIGS. 3 and 4) over which image data obtained by the camera 112 (shown in FIGS. 1 and 2) is kept when the camera 112 is in a deactivated state according to one example of the inventive subject matter described herein. The timeline projection 300 includes a horizontal axis 304 representative of time. The moving time window 302 represents a period of time over which image data is saved. Image data obtained during the time period encompassed by (e.g., included within) the moving time window 302 is saved and image data outside of the moving time window 302 is discarded.

The time window 302 begins at a starting time 306 (e.g., starting times 306*a-d*) and ends at a current time 308 (e.g., current times 308*a-d*). Each of the time windows 302 represents a different period of time. For example, when the camera 112 initially starts obtaining image data at a first starting time 306*a*, the image data is temporarily saved (e.g., on a memory device 202 of the vehicle 102, as shown in FIG. 2) from the starting time 306*a* to a current time. The memory device 202 can represent a read only and/or random access memory of the vehicle system 100, such as a computer hard drive, flash drive, optical disk, or the like. The memory device 202 optionally may be located on another vehicle 102, 104 of the same vehicle system 100, on another vehicle system 100, and/or in an off-board facility.

As the current time advances, the starting time 306 of the time window 302 also advances by the same amount. The starting time 306 of the time window 302 precedes the current time 308 by a designated period of time 310 such that the starting time 306 advances with the current time 308. The designated period of time 310 may be a length of time such as 30 seconds, one minute, five minutes, ten minutes, thirty minutes, or the like). As the starting time 306 advances, the image data acquired prior to the starting time 306 of a current time window 302 is discarded, such as by being erased.

When a stimulus is detected, the camera 112 is switched to an activated state. For example, when movement, sound, a change in force or acceleration in the vehicle system 100 is detected, the controller 114 can switch the camera 112 from the inactive state to an activated or active state. In the activated state, the image data obtained by the camera 112 can be saved in the memory device 202 for longer than the designated time window 302.

Figure 4:
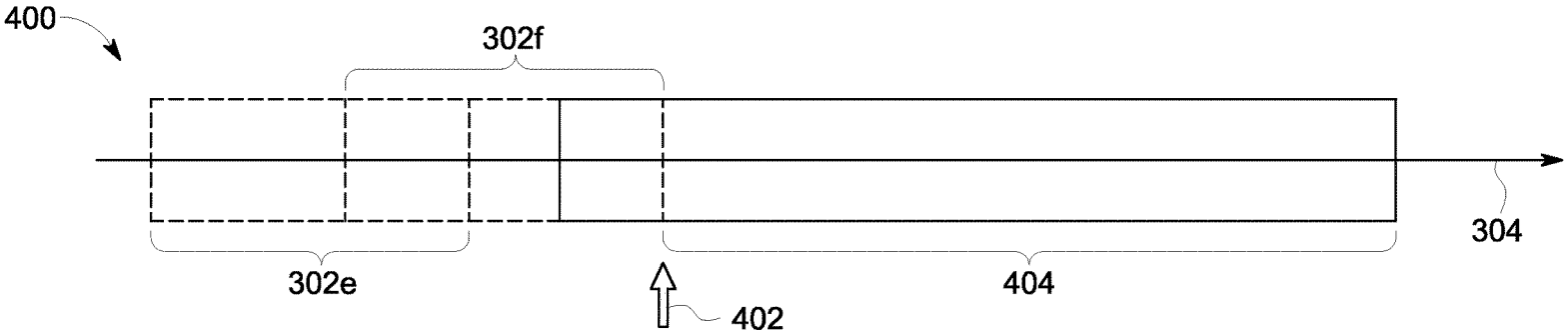
FIG. 4 illustrates a timeline projection of the image data obtained by the camera shown in FIG. 1 that is kept when the camera is in an activated state according to one example of the inventive subject matter described herein.

FIG. 4 illustrates a timeline projection 400 of the image data obtained by the camera 112 (shown in FIGS. 1 and 2) that is kept when the camera 112 is in an activated state according to one example of the inventive subject matter described herein. By "kept," it is meant that the image data is saved locally (e.g., on the memory device 202 shown in FIG. 2) and/or in a remote location (e.g., a dispatch facility or other location) for longer than the designated period of time 310 that defines the time windows 302 used when the camera 112 is in the deactivated or inactive state.

A stimulus event is detected at an event time 402. For example, movement inside the cab of the vehicle 102, a sound, acceleration of the vehicle 102, or the like, may be detected at the event time 402. Prior to the event time 402, the camera 112 may be in the deactivated state. Responsive to detecting the stimulus event, the controller 114 can switch the camera 112 to the activated state.

After being activated at the event time 402 (or shortly thereafter), the image data acquired by the camera 112 is saved in the memory device 202 (shown in FIG. 2). For example, the image data acquired by the camera 112 after the event time 402 may be saved in the memory over a longer time period 404 than the moving time window 302.

In one aspect, the controller 114 saves the image data obtained during the time window 302*f* that precedes the event time 402. When the controller 114 identifies the stimulus at the event time 402, the controller 114 may save the image data obtained by the camera 112 during the time window 302*f* that leads up to the event time 402 and may continue to save the image data obtained from the camera 112 subsequent to the event time 402. This image data before, during, and after the event time 402 can be saved in the memory device 202 or another location.

The time window 302 begins at a starting time 306 (e.g., starting times 306*a-d*) and ends at a current time 308 (e.g., current times 308*a-d*). Each of the time windows 302 represents a different period of time. For example, when the camera 112 initially starts obtaining image data at a first starting time 306*a*, the image data is temporarily saved (e.g., on a memory device 202 of the vehicle 102, as shown in FIG. 2) from the starting time 306*a* to a current time. As the current time advances, the starting time 306 of the time window 302 also advances by the same amount. The starting time 306 of the time window 302 precedes the current time 308 by a designated period of time 310 such that the starting time 306 advances with the current time 308. The designated period of time 310 may be a length of time such as 30 seconds, one minute, five minutes, ten minutes, thirty minutes, or the like). As the starting time 306 advances, the image data acquired prior to the starting time 306 of a current time window 302 is discarded, such as by being erased.

When a stimulus is detected, the camera 112 is switched to an activated state. For example, when movement, sound, a change in force or acceleration in the vehicle system 100 is detected, the controller 114 can switch the camera 112 from the inactive state to an activated or active state. In the activated state, the image data obtained by the camera 112 can be saved in the memory device 202 for longer than the designated time window 302.

Preserving the image data in this manner from before the event time 402 can be useful in identifying the cause of the stimulus that occurred at or near the event time 402. For example, at some point in time after the event time 402 (e.g., the next day, when the vehicle system 100 arrives at a destination, during a post-accident investigation, or the like), the image data can be obtained from the memory device 202 and examined to determine if the cause of the stimulus is shown in the image data obtained prior to the event time 402.

Returning to the description of the imaging system 110 shown in FIG. 2, the controller 114 can use data obtained by one or more sensors 116 (e.g., sensors 116*a*, 116*b*) and/or the camera 112 to detect the stimulus event that causes the camera 112 to switch from the inactive state to the active state. One example of the stimulus that can be used to activate the camera 112 includes a sound that is detected with an audio sensor 116*b*, such as a microphone. The audio sensor 116*b* can sense a sound and, when a decibel level exceeds a decibel threshold, a frequency of the sound exceeds a threshold, a frequency of the sound falls below a threshold, a frequency of the sound is within a frequency range, or the like, the controller 114 may determine that a stimulus event has occurred. The detected sound may be indicative of a door of the vehicle system 100 closing, opening, or the like. The sound could indicate a person entering or exiting the vehicle system 100. As described above, upon detection of such a stimulus event, the image data acquired prior to, during, and/or subsequent to the event can be saved for later examination to determine if someone entered into or exited from the vehicle 102 and/or whether the entry or exit was authorized.

Optionally, the controller 114 may differentiate background sounds from sounds generated by a stimulus event. For example, the controller 114 can subtract out or otherwise remove previously recorded or known background sounds from audio data obtained by the sensor 116*b*. If the remaining sound indicates a stimulus event, then the controller 114 can determine that the stimulus event has occurred.

Another example of the stimulus that is detected by the controller 114 to activate the camera 112 can be detection of a changing force or acceleration by a force or acceleration sensor 116*a*, such as an accelerometer. Upon detecting a change in the force or acceleration measured by the sensor 116*a*, the controller 114 may determine that the stimulus event has occurred. The changing force or acceleration could represent another vehicle system 100 or object colliding or otherwise running into the vehicle system 100 having the imaging system 110, a relatively hard coupling of the vehicle system 100 to one or more other vehicles (e.g., the coupling of one or more locomotives and/or rail cars to a locomotive having the imaging system onboard), or the like. As described above, the controller 114 can activate the camera 112 responsive to detection of such a stimulus event, and the image data acquired prior to, during, and/or after the stimulus event can be examined to determine the cause of the change in force or acceleration, liability for the cause of the change in force or acceleration, or the like.

Another example of the stimulus event detected by the controller 114 can be the sensing of movement in the field of view of the camera 112 using a data rate of the camera 112. For example, the camera 112 may acquire and/or compress the image data as the image data is obtained (or shortly thereafter) when the camera 112 in the inactive state and/or active state. During periods of inactivity in the field of view of the camera 112, the image data may represent highly redundant images over time. For example, when there is little to no movement or changes in the field of view of the camera 112, such as when there are no persons moving in the cab of the vehicle 102, then image data acquired at different times may be substantially similar and/or identical. As a result, the amount of compression of the image data can be relatively large, and the data rate (e.g., bit rate) at which the compressed image data is output from the camera 112 to the controller 114 and/or memory 202 may be relatively low (e.g., a slower rate than when movement is occurring within the field of view of the camera 112).

Another example of a stimulus event is a change in operational settings of the vehicle system 100. For example, the controller 114 can monitor throttle settings, brake settings, activation states of computer devices, or the like, onboard the same and/or another vehicle 102, 104. If one or more of these settings change, then the controller 114 can identify a stimulus event as occurring.

During periods of activity (e.g., movement of one or more persons within the field of view of the camera 112), the image data may represent images that significantly change over time. The image data acquired at a first time may be significantly different from the image data acquired at a different, second time due to movement of one or more objects (e.g., persons) within the field of view of the camera 112. As a result, redundancy in the image data may be less, the amount of compression of the image data can be smaller, and the data rate (e.g., bit rate) at which the compressed image data is output from the camera 112 may be larger.

This change in the data rate of the image data coming from the camera 112 can be used to detect movement within the field of view of the camera 112. The controller 114 can monitor the data rate of the camera 112. The data rate and/or changes in the data rate can be compared to one or more designated, non-zero thresholds by the controller 114 to identify a stimulus event. In one example, the controller 114 can use the data rate and/or changes in the data rate to differentiate between incidental movement versus movements of interest within the field of view of the camera 112. For example, an increase in the data rate resulting from birds flying by a window of the vehicle 102 may not cause a significant increase in the data rate and, as a result, is not identified as a stimulus event by the controller 114. In contrast, a larger movement within the field of view, such as a person entering the cab of the vehicle 102, passage of another vehicle system (e.g., a train, automobiles, or the like), or the like, can constitute larger movements in the field of view of the camera, which cause a significant increase in the data rate. As a result, these types of movements may be identified as a stimulus event by the controller 114. As described above, the controller 114 may then activate the camera 112 in response to identification of the stimulus event. In such a situation, the controller 114 can use the data rate of image data provided by and/or compressed by the camera 112 in order to identify entry of a person into the vehicle 102 without use of data processing intensive algorithms and/or error prone algorithms, such as image or facial recognition.

In one aspect of the inventive subject matter described herein, the detection of the stimulus event by the controller 114 may be used as a security feature of the imaging system 110. For example, the times at which entry into the vehicle 102 are authorized may be known to the controller 114 (e.g., by being stored in the memory device 202 and/or communicated to the controller 114 from an off-board facility). The controller 114 can compare the time at which a stimulus event is detected (e.g., the event time detected using the camera 112, the sensor(s) 116, or otherwise) to a list, table, or other memory structure of times or time periods that entry into the vehicle 102 is authorized or permitted by the owner, operator, caretaker, or the like, of the vehicle 102. Optionally, the controller 114 can compare the event time of the stimulus event to a list, table, or other memory structure of times or time periods that entry in to the vehicle 102 is not authorized or permitted. Based on either of these comparisons, the controller 114 can determine if the stimulus event represents an authorized or unauthorized entry into the vehicle 102. An unauthorized entry can be entry of a person into the vehicle or vehicle system that is never permitted to enter into the vehicle or vehicle system, or a person that is not permitted to enter into the vehicle or vehicle system at that time (but may be allowed to enter into the vehicle or vehicle system at another time).

Responsive to determining that the stimulus event represents or is caused by an unauthorized entry into the vehicle 102, the controller 114 may initiate one or more responsive actions. In one example, the controller 114 may direct an onboard alarm system 204 of the vehicle system 100 to actuate one or more alarms. Optionally, the alarm system 204 may be entirely or partially disposed onboard another vehicle 102 and/or 104 of the vehicle system 100. The alarms may include lights that are activated, sounds that are generated by speakers, or the like, to warn the person who entered into the vehicle 102 that their entry was detected, to notify others in the vicinity of the unauthorized entry into the vehicle 102, or the like. Additionally or alternatively, the controller 114 may deactivate the vehicle 102 and/or vehicle system 100 so that the unauthorized person in the vehicle 102 cannot operate the vehicle 102 or vehicle system 100. The controller 114 optionally may communicate an alarm signal using a communication device 206 of the vehicle 102.

The communication system 206 optionally may be entirely or partially disposed onboard another vehicle 102 and/or 104 of the vehicle system 100. The communication system 206 represents hardware circuits or circuitry that include and/or are connected with one or more computer processors (e.g., microprocessors) and communication devices (e.g., wireless antenna 208 and/or wired connections 210) that operate as transmitters and/or transceivers for communicating signals with one or more locations disposed off-board the vehicle 102. For example the communication system 206 may wirelessly communicate signals via the antenna 208 and/or communicate the signals over the wired connection 210 (e.g., a cable, bus, or wire such as a multiple unit cable, trainline, or the like) to a facility and/or another vehicle system, to another vehicle in the same vehicle system, or the like.

The controller 114 can cause the communication system 206 to transmit or broadcast the alarm signal to an off-board facility (e.g., a security company, a police station, or the like), to an operator disposed on another vehicle system or another vehicle in the same vehicle system, or the like, to notify of the unauthorized entry into the vehicle 102. As described above, the image data obtained prior to, during, and/or after the unauthorized entry (e.g., the stimulus event) can be examined to identify the person who made the unauthorized entry.

The controller 114 optionally can examine the data representative of the stimulus event to estimate a number of persons located in the vehicle 102. For example, changes in the rate at which the image data is compressed and/or provided from the camera 112 can be examined to determine when a stimulus event occurs. In one aspect, the controller 114 can compare the data rate and/or changes in the data rate to plural different thresholds. A first, lower threshold may be used to determine when one or more persons have entered into and/or are located within the vehicle 102. A second, larger threshold may be used to determine when two or more persons have entered into and/or are located within the vehicle 102. A third, larger threshold may be used to determine when a larger number of persons have entered into and/or are located within the vehicle 102, and so on. Depending on which of these thresholds that the data rate and/or change in the data rate exceeds, the controller 114 may estimate the number of persons that have entered into and/or are disposed within the vehicle 102.

The controller 114 can compare the estimated number of persons in the vehicle 102 with an authorized number of persons (e.g., stored in the memory device 202). If the estimated number is greater than the authorized number, then the controller 114 can generate one or more alarm signals, as described above.

The imaging system 110 optionally may adjust operational settings of the camera 112 and/or controller 114 to increase the accuracy of detecting stimulus events in or around the vehicle 102 and/or vehicle system 100 and/or to reduce false alarms. These adjustments can be made automatically (e.g., without operator intervention) and/or by suggesting the changes to an operator, who then implements the changes.

In one aspect, the controller 114 identifies changes in ambient conditions inside and/or outside the vehicle 102 or vehicle system 100, and modifies operational settings of the camera 112 in response thereto. For example, a location determining device 212 of the vehicle system 100 can generate data representative of where the vehicle system 100 is located and/or, a current date and/or time. The location determining device 212 can represent a global positioning system (GPS) receiver, a radio frequency identification (RFID) transponder that communicates with RFID tags or beacons disposed alongside the route, a computer that triangulates the location of the vehicle system 100 using wireless signals communicated with cellular towers or other wireless signals, a speed sensor (that outputs data representative of speed, which is translated into a distance from a known or entered location by the controller 114), or the like. The controller 114 receives this data and can determine the location of the vehicle 102 and/or the current date and/or time. Optionally, the controller 114 can track the current date and/or time, such as by using an internal clock or another device.

Based on the location, time, and/or date, the controller 114 can estimate the amount of light (or lack thereof) to which the vehicle 102 is exposed. If the vehicle 102 is in a location that is exposed to sunlight at the current time and/or date, then the controller 114 can change the operational settings of the camera 112 to reduce the amount of light entering the camera 112. For example, the controller 114 can reduce an aperture size of the camera 112, increase a shutter speed, or the like. As a result, the image data obtained by the camera 112 may more accurately reflect objects in the field of view of the camera 112. If the vehicle 102 is in a location that is exposed to low levels of light (or no light), and/or the vehicle 102 is exposed to low levels of light (or no light) at the current time and/or date, then the controller 114 can change the operational settings of the camera 112 to increase the amount of light entering the camera 112. For example, the controller 114 can increase an aperture size of the camera 112, decrease a shutter speed, or the like.

The controller 114 optionally may adjust the operational settings of the camera 112 based on current weather conditions at the location of the vehicle 102. For example, the controller 114 may receive weather data (e.g., from an off-board source, such as a dispatch facility, weather station, or the like) indicative of weather conditions at or near the vehicle 102. These conditions may represent the amount of clouds in the sky, the wind speed, precipitation, or the like. Based on these conditions, the controller 114 may change operational settings of the camera 112. For example, the controller 114 can increase the amount of light entering into the camera 112 when the weather conditions indicate significant cloud coverage, heavy rains, or the like, that reduce the amount of incident light on the vehicle 102. Or, the controller 114 can decrease the amount of light entering the camera 112, such as when the vehicle 102 is located in an area with snow coverage around the vehicle 102.

The controller 114 can use the identified ambient conditions (e.g., daylight, night, cloud coverage, precipitation, or the like) to change operational settings of the vehicle system 100 in order to modify the amount of light entering into the camera 112. For example, if the controller 114 determines that the ambient level of light is relatively low due to the time of day, location, and/or weather conditions, then the controller 114 may automatically activate lights inside and/or outside the vehicle system 100 to increase the amount of light in the field of view of the camera 112 to improve the images and/or videos obtained by the camera 112.

In another example, the controller 114 can change the thresholds to which the sounds detected by the audio sensor **116*b* are compared in order to identify a stimulus event based on the weather data. For example, if the controller 114 determines that the weather data indicates that the vehicle 102 is in an area experiencing heavy rainfall, hail, or the like, then the ambient noise around the vehicle 102 may be significant. As a result, the controller 114 can increase the decibel threshold(s) to which the detected sounds are compared in order to determine if a stimulus event occurs. This can prevent the sounds of rain, hail, or other precipitation being incorrectly identified as a stimulus event (e.g., a door of the vehicle 102** closing or opening).

The controller 114 may activate the camera 112 and/or modify the resolution at which the image data is acquired by the camera 112 based on a location of the vehicle system 100. For example, based on the location of the vehicle 102, the controller 114 can activate and/or increase the resolution of the camera 112 (e.g., change the camera 112 so that the minimum distance between two distinguishable objects in the image data obtained by the camera 112 is decreased). The controller 114 can do this in notable areas or locations of interest, such as at or near crossings between a route being traveled by the vehicle system 100 and another route, locations where previous accidents have occurred, locations where damage to the route and/or objects near the route has been identified, or the like. These notable areas or locations of interest may be previously identified and stored in the memory device 202. The controller 114 can then reduce the resolution and/or deactivate the camera 112 when the vehicle system 100 is no longer at or within the notable areas or locations of interest.

In one aspect of the inventive subject matter, the image data that is output from the camera 112 is saved onto one or more electronic files on the memory device 202. When the camera 112 is deactivated or in the inactive state, the image data may be saved into a first file on the memory device 202. As described above in connection with FIGS. 3 and 4, only a moving time window 302 of the image data may be saved in this file, and image data older than the starting time 306 of the moving time window 302 is discarded (in one embodiment). When the camera 112 is activated, the image data may be saved into a different, second file on the memory device 202. This second file may include the image data acquired at the event time 402 (shown in FIG. 4) and subsequent image data, as well as the image data from the moving time window 302 that led up to the event time 402.

The camera 112 optionally may be manually activated by an operator located onboard or off-board the vehicle system 100. An operator actuation device 214 can represent an input device, such as a button, switch, lever, pedal, touchscreen, keyboard, electronic mouse, stylus, microphone (e.g., for use with voice activation), or the like, that is actuated by an operator to cause the camera 112 switch to the active state or, if the camera 112 already is in the active state, to start saving the image data to a new file on the memory device 202. Optionally, the camera 112 can be manually activated or start saving to the new file by receiving a signal from an off-board location via the communication system 206.

In one embodiment, actuating the operator actuation device 214 additionally or alternatively can electronically mark or otherwise flag the file to which the image data is being saved. This mark or flag can be used to more quickly identify the time and/or location in the file where the operator activated the device 214. The operator can activate the device 214 when the operator sees something of interest that he or she wants to be reviewed in the image data at a later time.

The operator actuation device 214 may be used to request assistance from one or more other vehicle systems. For example, in response to seeing an item of interest in or near the route being traveled by the vehicle system 100, the operator can actuate the device 214 to cause an assistance request signal to be broadcast or transmitted to one or more other vehicle systems via the communication system 206. These other vehicle systems can include imaging systems 110 and/or cameras 112 that are actuated when the other vehicle systems reach or travel near the location where the operator actuated the device 214. In doing so, multiple sets of image data of the same location can be obtained by different imaging systems 110 and/or different vehicle systems. This additional image data can be used to verify or refute the potential identification of a problem near the route. Optionally, the assistance request signal may automatically be sent responsive to the camera 112 being switched from the inactive state to the active state.

The vehicle 102 (and/or one or more other vehicles 102 and/or 104 in the same vehicle system 100) may include a display device 216, such as a monitor, touchscreen, or the like, that presents the image data acquired by the camera 112. The display device 216 can present the image data for viewing by an onboard operator of the vehicle 102.

As described above in connection with the vehicle system 100 shown in FIG. 1, the imaging system 110 of the vehicle system 100 can include cameras 112 on multiple vehicles 102 and/or 104. The image data acquired by one or more of the cameras 112 can be stored in a memory device 202 of another vehicle. For example, the cameras 112 may be connected with each other in a network onboard the vehicle system 100 so that the image data acquired by multiple cameras 112 are stored at a common memory device 202. This network may be formed from wired and/or wireless connections (e.g., using the antennas 208, wired connections 210, and/or communication systems 206 on two or more of the vehicles 102 and/or 104) onboard the vehicle system 100.

In such a network, the image data can be routed to the controller 114 onboard one or more of the vehicles 102 and/or 104 for processing, and/or to one or more wireless communication devices attached to the network, but not disposed onboard the vehicle system 100. An operator disposed onboard one vehicle 102 or 104 can view the image data acquired by one or more cameras 112 disposed onboard one or more other vehicles 102, 104. The operator can then remotely monitor events occurring in areas of the vehicle system 100 that may not be easily accessible to the operator.

Optionally, the issuance of an alarm signal responsive to identification of a stimulus event on one vehicle 102 or 104 may be communicated to a vehicle 102 or 104 having an operator disposed onboard. This alarm signal can notify the operator of the stimulus event and cause the image data obtained onboard the same vehicle where the stimulus event was detected to be presented to the operator via the display device 216. This image data can be referred to as remotely acquired image data. The alarm signal can be sent so that an operator can view trespassers in another location of the vehicle system 100. The alarm signal and/or the remotely acquired image data may be automatically sent to the operator in response to detection of the stimulus event.

In another example, one or more sensors 106, such as fire detectors, smoke detectors, noxious gas detectors, motion detectors, or like, can issue alarm signals to an operator in another vehicle 102, 104. These sensors 106 can therefore notify the operator of any dangerous conditions on another vehicle 102, 104 in the same vehicle system 100, such as open windows, fires, broken windows, vandalized property, or the like. The image data of the corresponding vehicle 102, 104 also may be sent to the display device 216 near the operator, so that the operator can view the location of the dangerous condition in real time or near real time without the operator having to move to the location.

Inspections of the vehicles 102, 104 prior to departure of the vehicle system 100 can be accomplished without an operator or crew having to physically travel to the vehicles 102, 104 by communicating the image data acquired by several cameras 112 in the vehicle system 100 to a location where the operator or crew is located. Additionally, using the remotely acquired image data, one operator can check on the status of another operator or crew member on another vehicle. For example, an operator in a first vehicle 102 may check on the alertness of an operator in a second vehicle 102 by viewing the image data acquired in the second vehicle 102. If the operator in the second vehicle 102 is not alert or is not present, then the operator in the first vehicle 102 may direct the controller 114 to generate an alarm signal to be sent to the second vehicle 102 (or another location) to activate one or more alarms.

Additionally or alternatively, the controller 114 disposed onboard one or more vehicles 102, 104 and/or off-board the vehicle system 100 may apply facial recognition software or algorithms to the image data obtained onboard another vehicle in the vehicle system 100 to attempt to identify persons in the other vehicle. For example, upon detecting the entry of a person into a first vehicle 102, 104, the controller 114 onboard a second vehicle 102, 104 can examine the image data from the first vehicle using facial recognition software or algorithms to determine if the face of a person shown in the image data matches a previously stored facial image of a person approved to be inside the first vehicle. If the controller 114 is unable to determine that the person in the image data matches the approved facial image, then the controller 114 may generate one or more alarm signals to indicate the entry of a trespasser into the first vehicle.

Additionally or alternatively, the controller 114 can use facial recognition software or algorithms, or other detection software or algorithms, to examine the image data and estimate a number of individuals inside the first vehicle 102, 104. As described above, if the estimated number of individuals exceeds an authorized threshold number of individuals, then the controller 114 may generate one or more alarm signals. The alarm signals also can be generated if no persons are identified as being present in the first vehicle 102, 104.

With respect to a rail vehicle system, one or more embodiments of the imaging system 110 described herein can utilize live or recorded video streams made available by the imaging system 110 and communications between the controllers 114 and/or cameras 112, live or recorded video images from remotely located vehicles in the same vehicle system, and the like to view, store, and/or process the video streams. With access to the video from remote units (e.g., vehicles), a cab crew in another vehicle and/or operations personnel in a remote facility can be warned of a possible trespasser or operating rules violation in real time or near real time. This can avoid requiring personnel to travel from the remote facility to the vehicle system and/or requiring an onboard operator in another vehicle of the same vehicle system from moving to the remote vehicle where the trespassers or safety threat are located.

While one or more examples of the inventive subject matter described herein focus on cameras 112 disposed onboard and inside the vehicles 102, 104 of the vehicle system 100, optionally, one or more of the cameras 112 may be disposed onboard, but outside of the vehicles 102, 104. These exterior cameras 112 can be used to sense movement, record objects, and the like, similar to as described above in connection with the interior cameras 112. In one aspect, one or more (or all) of the cameras 112 of the imaging system 110 may be disposed outside of and off-board the vehicle system 100. For example, one or more cameras 112 can be coupled to a wayside device (or the cameras may be the wayside devices) so that the wayside cameras obtain image data of the vehicle system 100. These wayside cameras can record exterior portions of the vehicles 102, 104 and/or interior portions of the vehicles 102, 104, such as through one or more windows.

Figure 5:
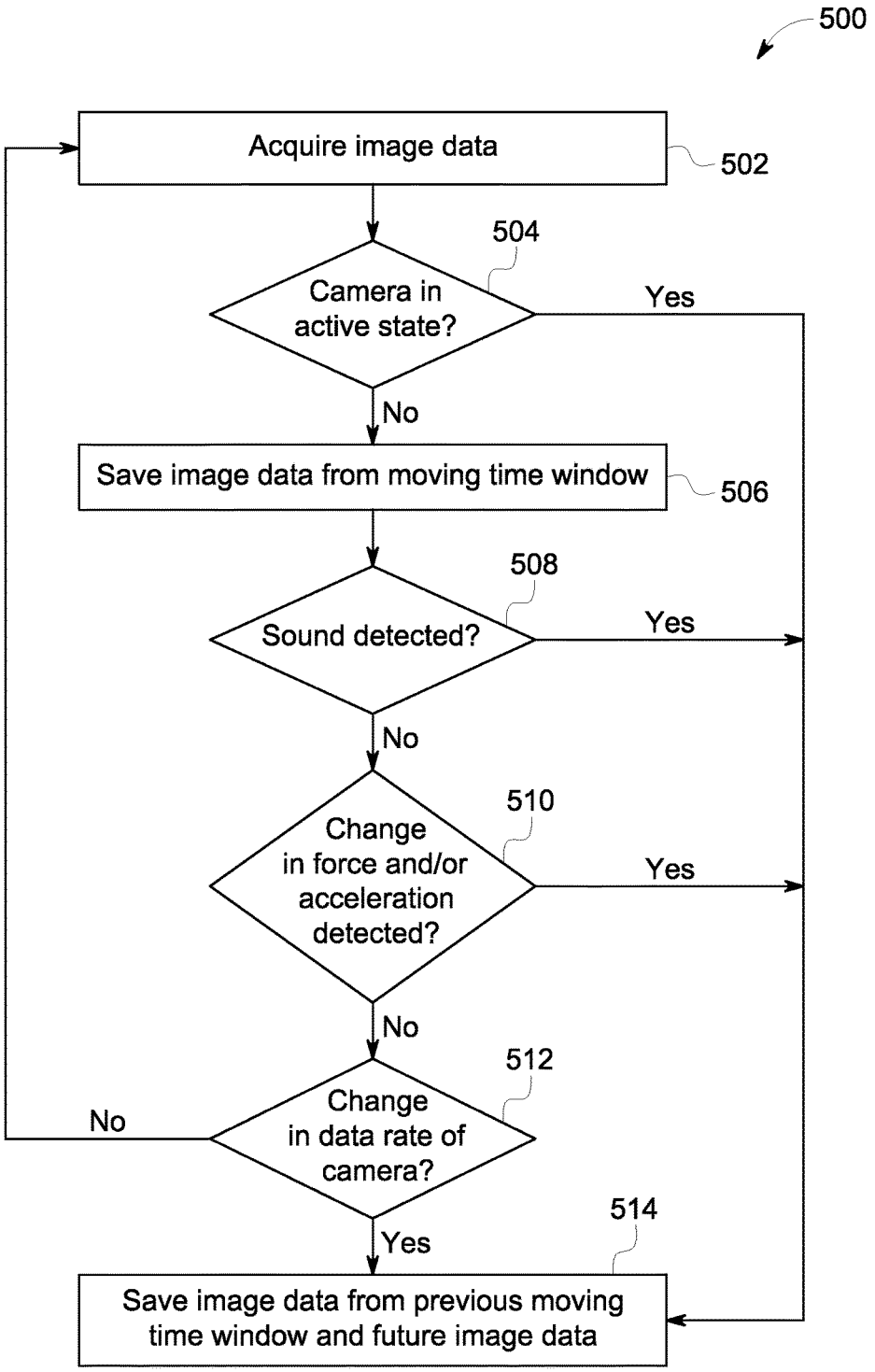
FIG. 5 illustrates a flowchart of a method for imaging a vehicle system according to one example of the inventive subject matter described herein.

FIG. 5 illustrates a flowchart of a method 500 for imaging a vehicle system according to one example of the inventive subject matter described herein. In one embodiment, the method 500 may be performed or practiced using the imaging system 110 (shown in FIG. 1) described above. Optionally, another system may be used.

At 502, image data is acquired by one or more cameras. The cameras may be IP digital HD cameras, or another type of camera, such as a non-HD camera, a non-IP camera, or another camera. The image data can represent still images and/or videos.

At 504, a determination is made as to whether the camera is in an active state. In the active state, the image data acquired by the camera may be saved, such as in a local or remote (e.g., networked) memory device, for later analysis or examination. In the inactive state, the image data may only be saved for a moving time window that precedes a current time. As the current time advances, the image data acquired prior to the length of time of the moving time window is discarded (e.g., erased).

If the camera is in the inactive state or is off, then flow of the method 500 can proceed toward 506. If the camera is in the active state, then flow of the method 500 can proceed toward 514.

At 506, the image data acquired by the camera in the inactive state is saved for a moving time window. As described above, older image data can be erased or otherwise not kept for later analysis or review in the inactive state.

At 508 through 512, several checks on whether a stimulus event occurs are performed. The order in which these checks can be performed may vary from that shown in the flowchart, one or more of these checks may not be performed, and/or one or more of the checks may be performed multiple times.

At 508, a determination is made as to whether a sound is detected. For example, the sounds sensed by a microphone or other sensor may be examined to determine if an abnormal sound or sound of interest is identified. An abnormal sound or sound of interest may be a sound that differs from background (e.g., ambient) sounds, such as a door opening or closing, an object being dropped, footsteps, a human voice, breaking glass (or other material), and the like.

If a sound is detected, then the sound may represent a stimulus event, such as a person entering into the vehicle system. As a result, flow of the method 500 can proceed toward 514. If no sound is detected, then flow of the method 500 can proceed toward 510.

At 510, a determination is made as to whether a force or change in acceleration is experienced by the vehicle or vehicle system. For example, a force sensor, accelerometer, or the like, may be used to determine if another object (e.g., another vehicle) has collided with the vehicle or vehicle system, if the vehicle or vehicle system is moving, or the like.

If such a force or acceleration is detected, then the force or acceleration may represent a stimulus event, such as a collision or hard coupling of the vehicle or vehicle system with another vehicle or vehicle system. As a result, flow of the method 500 can proceed toward 514. If no sound is detected, then flow of the method 500 can proceed toward 512.

At 512, a determination is made as to whether a rate at which image data is output by the camera changes (e.g., whether a data rate changes). For example, the speed at which image data is compressed by the camera, the speed at which the image data is communicated from the camera to another device, or the like, may be monitored.

If this data rate changes, such as by increasing beyond a designated threshold amount, then the increase in the data rate can indicate that more image data is being output by the camera, that the compression of the image data has decreased, or the like. This decrease in compression, increase in image data, or the like, may indicate that the image data obtained by the camera is less redundant. The decrease in image redundancy can represent movement in the field of view of the camera. For example, the change in the data rate can indicate that a person is moving in the field of view of the camera. As a result, flow of the method 500 can proceed toward 514.

On the other hand, if the data rate does not increase or does not increase by more than a designated threshold amount, then the data rate or change in the data rate may not indicate movement in the field of view of the camera. As a result, flow of the method 500 can return toward 502. For example, the method 500 can proceed in a loop-wise manner unless or until a stimulus event is detected. In one embodiment, the method 500 also may include determining if one or more operational settings or controls have been changed onboard the vehicle or vehicle system. Such a change may indicate a person onboard the vehicle or vehicle system, and may be a stimulus event that causes the method 500 to proceed to 514. Otherwise, flow of the method 500 can return to 502.

At 514, the camera switches to the active state, and image data obtained by the camera is saved. For example, the image data obtained during the time window that ended at the time that the stimulus event is detected and additional image data obtained after the time that the stimulus event is detected may be saved in a memory device. In doing so, the image data acquired before, during, and after the stimulus event may be preserved for examination in order to determine the cause of the stimulus event.

In one example of the inventive subject matter described herein, a system (e.g., an imaging system) includes a camera and a controller. The camera is configured to be disposed on a first vehicle system or at a wayside location along a route to generate image data within a field of view of the camera. The controller is configured to monitor a data rate at which the image data is provided from the camera. The controller also is configured to identify a stimulus event within the field of view of the camera based on a change in the data rate at which the image data is generated by the camera.

In one aspect, the controller is configured to identify the stimulus event as movement within the field of view of the camera.

In one aspect, the controller also is configured to activate one or more alarms responsive to identifying the stimulus event.

In one aspect, the data rate at which the image data is provided from the camera represents a bit rate at which the image data is compressed by the camera.

In one aspect, the controller is configured to identify the stimulus event in the field of view of the camera when a compression of the image data decreases by more than a designated, non-zero threshold decrease.

In one aspect, the first vehicle system includes at least a first vehicle and a second vehicle mechanically coupled with each other. The camera can be configured to be disposed onboard the first vehicle and the controller is configured to be disposed onboard the second vehicle in order to remotely monitor for the stimulus event in the first vehicle.

In one aspect, the controller is configured to determine at least one of a time or date at which the stimulus event occurs based on the data rate at which the image data is provided from the camera. The controller can be configured to compare the at least one of the time or date to an authorized time or an authorized data to determine if the stimulus event is authorized.

In one aspect, the controller is configured to compare one or more images formed from the image data to one or more authorized images representative of persons having authorization to be in the first vehicle system. The controller also can be configured to generate an alarm signal responsive to the one or more images differing from the one or more authorized images.

In one aspect, when the camera is in an inactive state, the camera is configured to save only the image data obtained during a moving time window that extends backward from a current time to a previous time by a designated, non-zero time period. When the camera is in an active state, the controller is configured to save the image data obtained during the moving time window and the image data obtained outside of the moving time window.

In one aspect, the system also includes at least one of a force sensor or an audio sensor. The force sensor can be configured to detect a change in acceleration of the first vehicle system. The audio sensor can be configured to detect a sound in the first vehicle system. The controller can be configured to switch the camera from the inactive state to the active state responsive to at least one of the force sensor detecting the change in acceleration or the audio sensor detecting the sound.

In one aspect, the controller is configured to automatically communicate an assistance request signal to one or more second vehicle systems responsive to the camera switching from an inactive state to an active state. The assistance request signal can request the one or more second vehicle systems to acquire additional image data at or near a location of the first vehicle system when the camera switched from the inactive state to the active state.

In one aspect, the system also includes an operator activation device configured to be actuated by an operator of the first vehicle system to manually switch the camera from the inactive state to the active state.

In one aspect, the controller also is configured to automatically generate a warning signal that is communicated to an off-board facility responsive to the operator activation device being actuated.

In one aspect, the controller also is configured to identify a location of the first vehicle system when at least one of the change in acceleration or the sound is detected. The controller also can be configured to save the image data and the location of the first vehicle system in a memory device.

In one aspect, the controller can be configured to automatically communicate an assistance request signal to one or more second vehicle systems responsive to the camera switching from the inactive state to the active state, the assistance request signal requesting the one or more second vehicle systems to acquire additional image data at a location of the first vehicle system when the camera switched from the inactive state to the active state.

In one aspect, the camera is configured to compress the image data into compressed image data, and to output the compressed image data at the data rate. The data rate includes a bit rate. The controller is configured to monitor the bit rate at which the compressed image data is output and to identify the stimulus event responsive to the bit rate changing by at least a designated threshold. The controller also can be configured to generate one or more alarm signals responsive to the bit rate changing by at least the designated threshold.

In another example of the inventive subject matter described herein, a method (e.g., an imaging method) includes obtaining image data of a field of view of a camera. The field of view includes at least a portion of a first vehicle system. The method also includes monitoring, with one or more computer processors, a data rate at which the image data is provided from the camera, and identifying (with the one or more computer processors) a stimulus event within the field of view of the camera based on a change in the data rate at which the image data is generated by the camera.

In one aspect, the data rate that is monitored is a bit rate at which the image data is compressed by the camera.

In one aspect, the stimulus event is movement within the field of view of the camera.

In one aspect, the stimulus event in the field of view of the camera is identified when a compression of the image data decreases by more than a designated, non-zero threshold decrease.

In one aspect, the method also includes determining at least one of a time or date at which the stimulus event occurs based on the data rate at which the image data is provided from the camera, and comparing the at least one of the time or date to an authorized time or an authorized date, respectively, to determine if the stimulus event is authorized.

In one aspect, the method also includes comparing one or more images formed from the image data to one or more authorized images representative of persons having authorization to be in the first vehicle system, and generating an alarm signal responsive to the one or more images differing from the one or more authorized images.

In one aspect, the method also includes detecting at least one of a change in acceleration of the first vehicle system or a sound in the first vehicle system, and switching the camera from an inactive state to an active state responsive to detecting the at least one of the change in acceleration or the sound.

In one aspect, the method also includes automatically communicating an assistance request signal to one or more second vehicle systems responsive to the camera switching from an inactive state to an active state. The assistance request signal requests the one or more second vehicle systems to acquire additional image data at or near a location of the first vehicle system when the camera switched from the inactive state to the active state.

In another example of the inventive subject matter described herein, a system (e.g., an imaging system) includes a camera and a controller. The camera is configured to be disposed onboard a first vehicle of a vehicle system that includes the first vehicle and at least a second vehicle mechanically coupled with each other. The camera also is configured to obtain image data, compress the image data into compressed image data, and output the compressed image data at a bit rate. The controller is configured to monitor the bit rate at which the compressed image data is output and to identify a stimulus event occurring on or at the first vehicle responsive to the bit rate changing by at least a designated threshold. The controller also is configured to generate one or more alarm signals responsive to the bit rate changing by at least the designated threshold.

In one aspect, the controller is configured to be disposed onboard the second vehicle to remotely monitor the first vehicle via the camera.

In one aspect, the controller is configured to identify movement in the first vehicle based on the bit rate decreasing by at least the designated threshold.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

This written description uses examples to disclose several embodiments of the inventive subject matter and also to enable a person of ordinary skill in the art to practice the embodiments of the inventive subject matter, including making and using any devices or systems and performing any incorporated methods. The patentable scope of the inventive subject matter is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The foregoing description of certain embodiments of the inventive subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, processors or memories) may be implemented in a single piece of hardware (for example, a general purpose signal processor, microcontroller, random access memory, hard disk, and the like). Similarly, the programs may be stand-alone programs, may be incorporated as subroutines in an operating system, may be functions in an installed software package, and the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" of the inventive subject matter are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

What is claimed is:

1. A system comprising:

a sensor configured to sense stimulus information of a first vehicle system;

a camera configured to be disposed onboard the first vehicle system, the camera configured to generate image data representative of a field of view of the camera, to compress the image data into compressed data, and to output the compressed data at a bit rate;

a controller configured to monitor the stimulus information sensed by the sensor and to activate the camera from an inactive state to an active state responsive to the stimulus information exceeding a first threshold, wherein the controller also is configured to monitor the bit rate at which the compressed data is output by the camera to the controller after the camera is activated and generating the image data, the controller configured to determine a change in the bit rate that is monitored and to identify a stimulus event based on the change in the bit rate that is determined, wherein the controller is configured to determine at least one of a time or date at which the stimulus event occurs and to compare the at least one of the time or date to an authorized time or an authorized date, respectively, to determine whether the stimulus event is authorized.

2. The system of claim 1, wherein the controller is configured to identify the stimulus event as movement.

3. The system of claim 1, wherein the controller also is configured to activate one or more alarms responsive to identifying the stimulus event.

4. The system of claim 1, wherein the controller is configured to identify the stimulus event responsive to a compression of the image data decreasing by more than a designated, non-zero second threshold.

5. The system of claim 1, wherein the first vehicle system includes at least a first vehicle and a second vehicle mechanically coupled with each other, and wherein the camera is disposed onboard the first vehicle, and wherein the controller is configured to be disposed onboard the second vehicle in order to remotely monitor for the stimulus event in the first vehicle.

6. The system of claim 1, wherein the controller is configured to compare one or more images formed from the image data to one or more authorized images representative of persons having authorization to be in the first vehicle system, and the controller is configured to generate an alarm signal responsive to the one or more images differing from the one or more authorized images.

7. The system of claim 1, wherein, when the camera is in the inactive state, the camera is configured to save only the image data obtained during a moving time window that extends backward from a current time to a previous time by a designated, non-zero time period and, when the camera is in the active state, the controller is configured to save the image data obtained during the moving time window and the image data obtained outside of the moving time window.

8. The system of claim 1, wherein the sensor includes at least one of a force sensor or an audio sensor, the force sensor configured to detect a change in acceleration of the first vehicle system as the stimulus information, the audio sensor configured to detect a sound in the first vehicle system as the stimulus information, wherein the controller is configured to switch the camera from the inactive state to the active state responsive to at least one of the force sensor detecting the change in acceleration or the audio sensor detecting the sound.

9. The system of claim 1, wherein the controller is configured to automatically communicate an assistance request signal to one or more second vehicle systems responsive to the camera switching from the inactive state to the active state, the assistance request signal requesting the one or more second vehicle systems to acquire additional image data at a location of the first vehicle system when the camera switched from the inactive state to the active state.

10. The system of claim 1, wherein the controller also is configured to generate one or more alarm signals responsive to the bit rate changing by at least the first threshold.

11. The system of claim 1, wherein the controller also is configured to identify the stimulus event responsive to both a change in an operational setting of the first vehicle and the change in the bit rate.

12. The system of claim 1, wherein the controller is configured to change the first threshold based on a weather condition.

13. The system of claim 1, wherein the controller is configured to determine a number of persons onboard the first vehicle system based on the change in the bit rate.

14. The system of claim 1, wherein the controller is configured to change a resolution of the camera based on one or more of a location of the first vehicle system or a weather condition.

15. A method comprising:

sensing stimulus information of a first vehicle system using a sensor;

activating a camera onboard the first vehicle system from an inactive state to an active state responsive to the stimulus information that is sensed by the sensor exceeding a first threshold;

subsequently obtaining image data using the camera that represents at least a portion of the first vehicle system;

compressing the image data into compressed data using the camera;

outputting the compressed data from the camera to one or more computer processors at a bit rate;

determining, with the one or more computer processors, a change in the bit rate at which the compressed data is output by the camera;

identifying, with the one or more computer processors, a stimulus event based on the change in the bit rate at which the compressed data is output by the camera;

determining at least one of a time or date at which the stimulus event occurs based on the bit rate at which the compressed data is output by the camera; and comparing the at least one of the time or date to an authorized time or an authorized date, respectively, to determine whether the stimulus event is authorized.

16. The method of claim 15, wherein the stimulus event is identified responsive to a compression of the image data decreasing by more than a designated, non-zero second threshold.

17. The method of claim 15, further comprising comparing one or more images formed from the image data to one or more authorized images representative of persons having authorization to be in the first vehicle system, and generating an alarm signal responsive to the one or more images differing from the one or more authorized images.

18. The method of claim 15, further comprising detecting at least one of a change in acceleration of the first vehicle system or a sound in the first vehicle system as the stimulus information using the sensor, and switching the camera from the inactive state to the active state responsive to detecting the at least one of the change in acceleration or the sound.

19. The method of claim 15, further comprising automatically communicating an assistance request signal to one or more second vehicle systems responsive to the camera switching from the inactive state to the active state, the assistance request signal requesting the one or more second vehicle systems to acquire additional image data at or near a location of the first vehicle system when the camera switched from the inactive state to the active state.

20. The method of claim 15, further comprising identifying the stimulus event based on both a change in an operational setting of the first vehicle and the change in the bit rate.

21. A system comprising:

a sensor configured to sense stimulus information one or more of around or in a first vehicle;

a camera configured to be disposed onboard the first vehicle and to switch to an active state based on the stimulus information sensed by the sensor, the camera configured to generate image data, to compress the image data into compressed data, and to output the compressed data at a bit rate; and a controller configured to monitor the bit rate at which the compressed data is output by the camera, the controller also configured to determine a change in the bit rate and to identify a stimulus event occurring at the first vehicle responsive to determining that the bit rate changes by at least a designated threshold, the controller also configured to generate one or more alarm signals responsive to the bit rate changing by at least the designated threshold, wherein the controller is configured to identify the stimulus event in the first vehicle based on the bit rate decreasing by at least the designated threshold.

22. The system of claim 21, wherein the controller is configured to be disposed onboard a second vehicle to remotely monitor the first vehicle via the camera.

23. The system of claim 21, wherein the controller is configured to identify movement in the first vehicle based on the bit rate decreasing by at least the designated threshold.

* * * * *